US006438886B1

(12) United States Patent
Neumann

(10) Patent No.: US 6,438,886 B1
(45) Date of Patent: Aug. 27, 2002

(54) PISTOL LOCKING DEVICE

(75) Inventor: Ingo Alberto Neumann, Porto Alegre (BR)

(73) Assignee: Forjas Taurus S/A, Porto Alegre (BR)

( * ) Notice: Subject to any disclaimer, the term of this patent is extended or adjusted under 35 U.S.C. 154(b) by 0 days.

(21) Appl. No.: 09/573,286

(22) Filed: May 18, 2000

(51) Int. Cl.[7] ..... F41A 17/02; F41A 17/00
(52) U.S. Cl. ..... 42/70.11
(58) Field of Search ..... 42/70.11

(56) References Cited

U.S. PATENT DOCUMENTS 2,945,316 A * 7/1960 Mulno ..... 42/66
3,553,877 A * 1/1971 Welch et al. ..... 42/70.01
3,720,014 A * 3/1973 Goodrich ..... 42/70.11
5,081,779 A * 1/1992 Pack ..... 42/70.11
5,546,690 A * 8/1996 Ciluffo ..... 42/70.11
5,671,560 A * 9/1997 Meller ..... 42/70.11
5,782,028 A * 7/1998 Simon et al. ..... 42/70.11
5,910,003 A * 6/1999 Kleinpaul ..... 42/70.11
6,041,536 A * 3/2000 Samuels et al. ..... 42/70.11

* cited by examiner

*Primary Examiner*—Charles T. Jordan
*Assistant Examiner*—John W. Zerr

(57) ABSTRACT

A safety device for application in pistols, which basically comprises a cylinder provided on the outer portion thereof with a helical channel, and on the upper portion thereof with a recess for the end of a key and centrally with a through hole which, in the unlocked position of pistol, is aligned with the course of stem of master spring. Such device prevents the pistol from being cocked when the safety device is in the locked position.

9 Claims, 5 Drawing Sheets

PISTOL LOCKING DEVICE

BACKGROUND OF THE INVENTION

The present invention refers to a locking mechanism for pistols of the type actuated by a key and incorporated into conventional-type pistols.

It is known in the art to use keys for the actuation of safety mechanisms in revolvers, such as described on the documents Brazilian Patent Applications 8904218 and 9604463, both belonging to Forjas Taurus S/A, a Brazilian company and the assignee of the instant application.

In respect of pistols, a known safety mechanism is employed by the semi-automatic pistol Colt 45 Model 1911A1, wherein a lateral stem or button directly actuates a mechanism attached to the firing pin, preventing the firing pin from moving when the stem is in the locked position. However, since the movement of the hammer (and mainly the strike thereon against the firing pin) is not prevented, the entire energy released by the hammer, in the event of a shot, is absorbed by the safety mechanism, which can cause the premature rupture of the firing pin. Accordingly, it is an object of the present invention to provide a safety mechanism capable of preventing the accidental firing of pistols and that actuates so as to prevent the movement of the hammer.

SUMMARY OF THE INVENTION

In accordance with the present invention, the foregoing objects and advantages are readily achieved.

The present invention provides a locking device for pistols of the ordinary type and designed to prevent the pistol from being cocked when the locking device is in the locked position, wherein the pistol frame is provided on the rear lower portion thereof with an orifice, and wherein a cylinder is arranged laterally provided with a helical notch or channel and, on the upper portion thereof, a recess to receive the end of a key, and a through hole, said through hole being aligned with the course of the master spring stem when the pistol is in the unlocked condition.

BRIEF DESCRIPTION OF THE DRAWINGS

The object of the present invention will be best understood in the light of the annexed drawings, shown by way of non-limiting examples wherein.

DETAILED DESCRIPTION OF PREFERRED EMBODIMENTS

In accordance with the appended drawings, 15 generally indicates a simple-strike pistol, the firing of which is done by hammer 8, directly or indirectly on the firing pin (not shown). The stroke of the hammer is performed by action of the master spring 7 acting on hammer 8 by means of a stem 6. In addition, said master spring 7 is arranged so as to surround the lower portion of said stem 6.

The locking device subject matter of the present invention basically comprises a cylinder 1 located inside the pistol frame and specifically in the lower, rear portion of said frame and intercepting the course of stem 6 of spring 7.

Figure 3A:
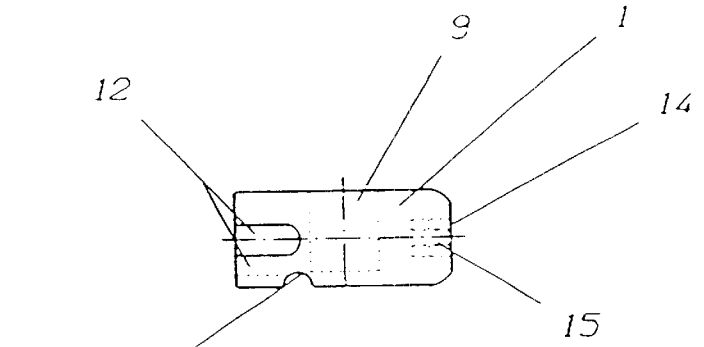
FIG. 3*a* is a lateral view of the cylindrical body.
Figure 3B:
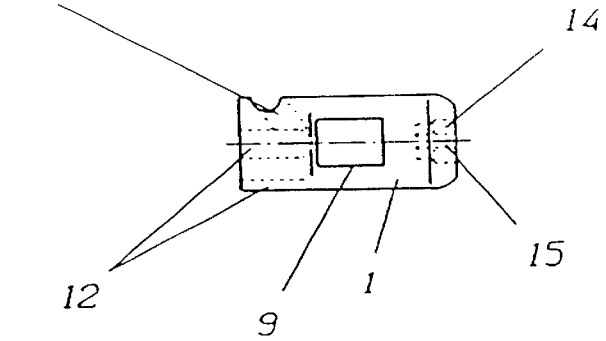
FIG. 3*b* is a further view of the cylindrical body.
Figure 4:
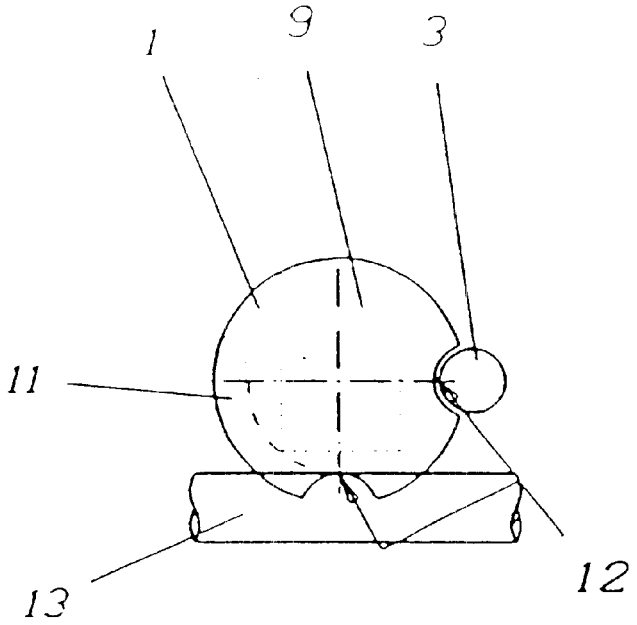
FIG. 4 is a lower view of the same cylindrical body.
Figure 5:
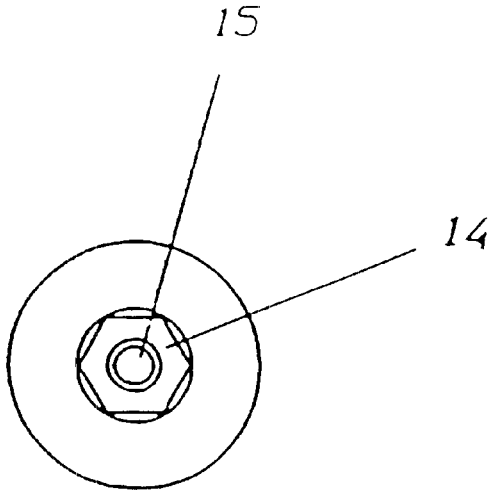
FIG. 5 is an upper view of the cylindrical body.
Figure 7:
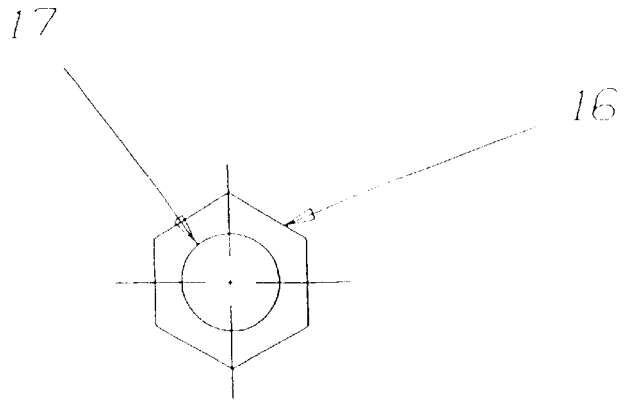
FIG. 7 is a lower view of the key.
Figure 6:
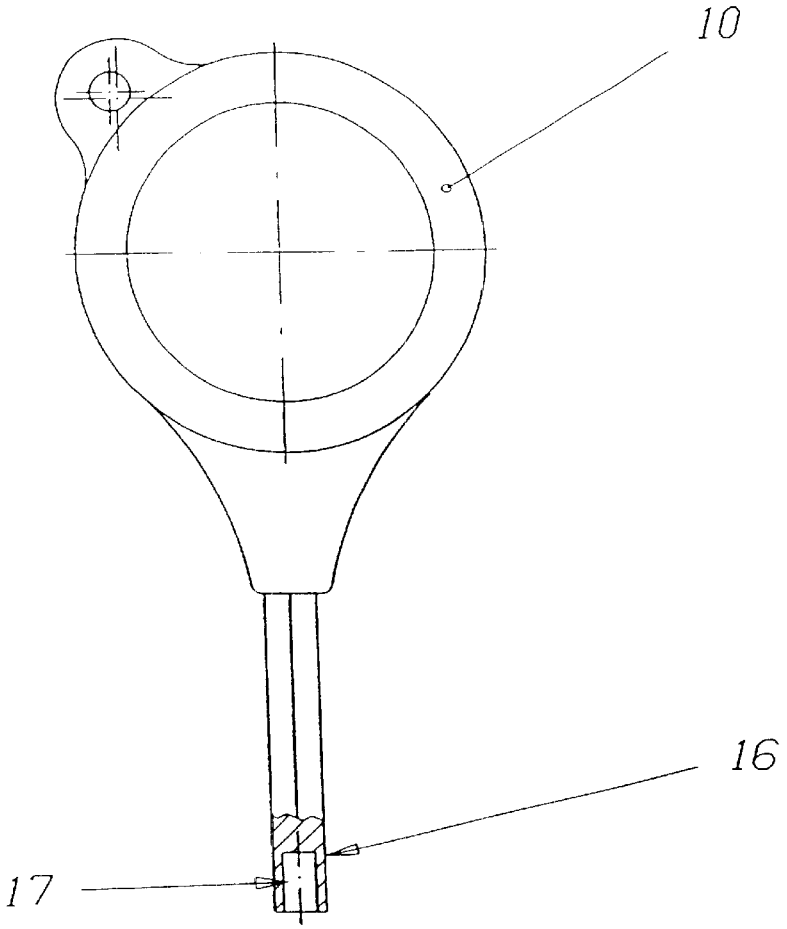
FIG. 6 is a lateral view of the key.

More specifically, the body 5 of pistol 15 is provided with an orifice on the lower, rear portion thereof, that intercepts the course of stem 6. Inside said orifice is arranged a cylinder 1 having on the outer portion thereof a helical channel. 11 (see FIGS. 3*a* and 3*b*) that interacts with a sphere 3 maintained in position through a spring 4, in addition to a through hole 9 having a diameter larger than that of the lower portion of stem 6 of master spring 7. The cylinder 1 is further provided with positioning recesses 12, as best shown on FIG. 4. The upper portion of cylinder 1 is provided with a recess 13 (see FIG. 5) having a shape complementary with the end 14 of key 10 (see FIG. 6), so as to be able to turn by action of said key 10, inside the orifice of body 5 of pistol 15.

When in use, said cylinder may basically assume two positions, one being locked and the other unlocked.

Figure 1:
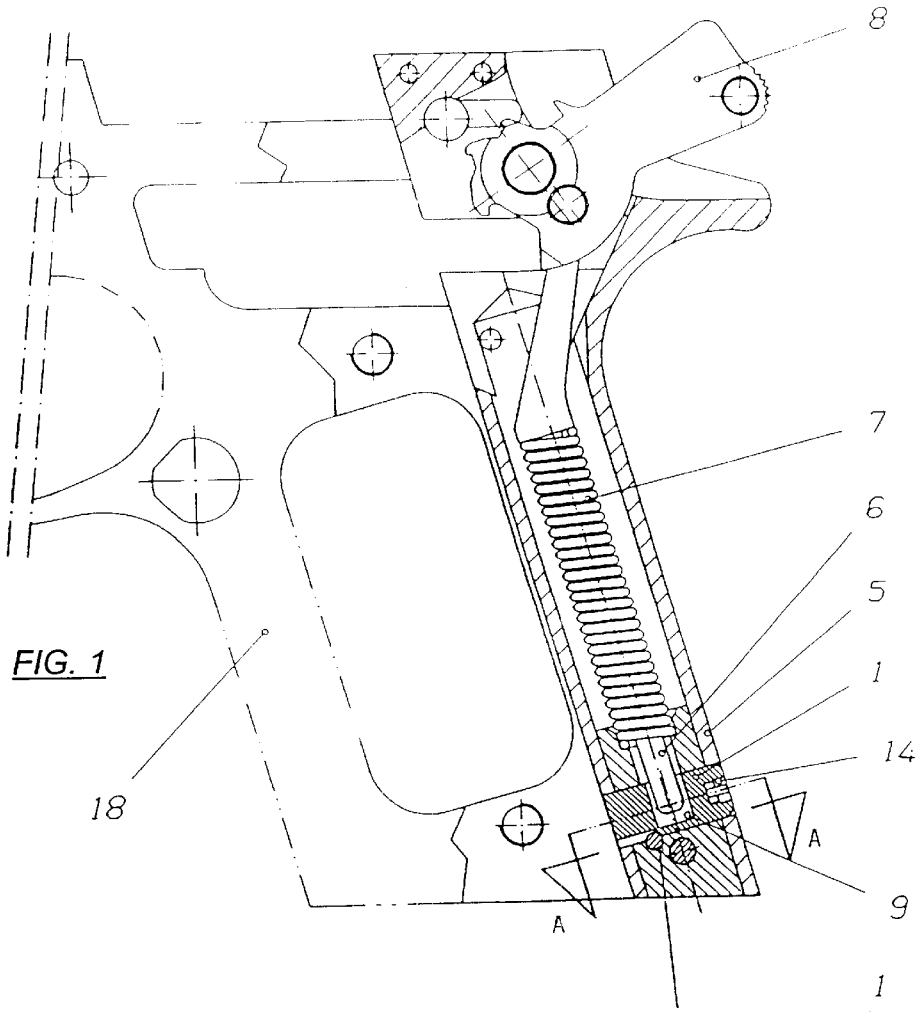
FIG. 1 is a partial section view of a pistol provided with the safety device subject matter of the present invention.
Figure 1A:
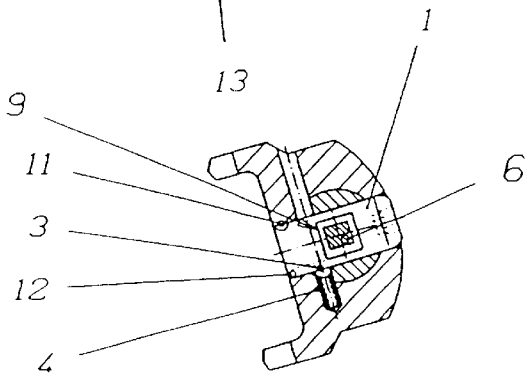
FIG. 1*a* is a detail in section, according to line A—A of FIG. 1.

In the unlocked position, as shown on FIGS. 1 and 1*a*, the through hole 9 of cylinder 1 is positioned exactly around the course of stem 6 of master spring 7, thereby allowing it, by action of the hammer return movement, to cross said cylinder 1, thereby cocking pistol 15.

On the other hand, in the locked position (see FIGS. 2 and 2*a*), cylinder 1 is displaced in relation to the previous, unlocked position, so that the through hole 9 no longer coincides with the course of stem 6 of master spring 7. In that position, stem 6 cannot perform a return movement and, accordingly, the pistol 15 cannot be cocked, the operation thereof being accordingly completely prevented.

Figure 2:
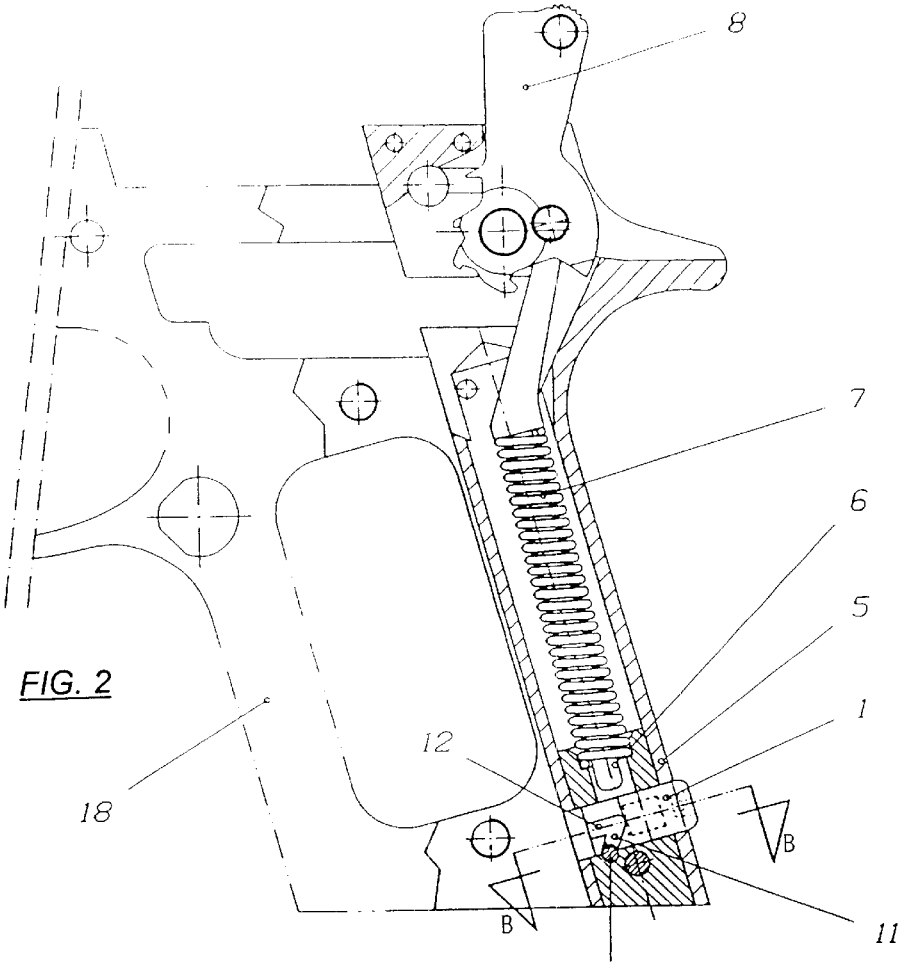
FIG. 2 is a view similar to FIG. 1, however showing the pistol in the locked condition.
Figure 2A:
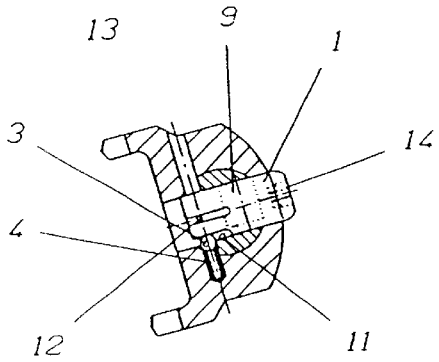
FIG. 2*a* is a detail in section according to line B—B of FIG. 2.

The locking of pistol 15 is done by means of key 10, the end 14 thereof being inserted in recess 13 in the head of cylinder 1. Thereupon, the key is turned by 90° and, accordingly, the cylinder 1, in addition to turning, is displaced outwards, as a result of the action of sphere 3 against the helical channel 11 and as shown in FIG. 2. In order to resume the utilization of pistol 15, it suffices to turn cylinder 1 again, by means of key 10, in a direction opposite to the one employed for the locking thereof, said movement causing the rotation and insertion of cylinder 1 in relation to its seat orifice, up to a final position wherein the through hole 9 is again aligned with the course of the lower portion of stem 6 of master spring 7. Such position is not random, but is insured by the positioning recesses 12.

Finally, it should be pointed out that the safety device described above possesses as a main advantage thereof a safe system that can only be released by a specific key 10. The shape of the end 14 of key 10 can be hexagonal, as illustrated, or may then assume any configuration, even an irregular one, so as to prevent the use of other tools for the unlocking of pistol 15.

In addition, since the cylinder 1 acts so as to prevent the pistol from being cocked, the pistol is not subjected to the application of large forces, in the event of an attempt of cocking the pistol by an unauthorized person.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. Locking device for pistols, which comprises:

a pistol frame having a lower, rear portion thereof;

a master spring in said frame and a stem acting on said master spring;

an orifice in said frame on said lower, rear portion thereof, and a cylinder in said orifice having an upper portion thereof, wherein said cylinder intercepts the course of said stem and includes a locked and unlocked position;

a helical channel in said cylinder;

a key having an end thereof;

a recess on the upper portion of said cylinder operative to receive the end of said key, wherein said key is operative to displace said cylinder from the unlocked to locked position and from the locked to unlocked position;

a through hole in said cylinder aligned with said stem to receive said stem when-the cylinder is in the unlocked position, and said through hole is out of alignment with said stem when the cylinder is in the locked position;

wherein said locking device prevents the pistol from being cocked when the cylinder is displaced to the locked position.

2. A device according to claim 1, wherein the pistol includes a hammer and the stroke of the hammer is performed by action of said master spring acting on the hammer by said stem, wherein in the unlocked position the stem passes through said through hole allowing movement of said hammer.

3. A device according to claim 2, wherein said cylinder has a lower portion thereof and wherein said lower portion of said cylinder is provided with at least one positioning recess.

4. A device according to claim 2, wherein the end of said key is provided with a hexagonal shape.

5. A device according to claim 2, wherein said through hole is provided centrally of said cylinder.

6. A device according to claim 2, including a sphere interacting with said helical channel through a spring.

7. A device according to claim 2, wherein said stem has a lower portion thereof with a diameter thereof, and wherein said through hole has a diameter larger than the diameter of the lower portion of said stem.

8. A device according to claim 2, wherein said cylinder blocks movement of said stem in the locked position.

9. A device according to claim 1, wherein said lower rear portion of the frame is the pistol grip.

* * * * *